United States Patent [19]

Ferris

[11] 4,013,195

[45] Mar. 22, 1977

[54] EXPULSION BLADDER

[75] Inventor: DeLacy F. Ferris, Canoga Park, Calif.

[73] Assignee: Rockwell International Corporation, El Segundo, Calif.

[22] Filed: Feb. 18, 1975

[21] Appl. No.: 550,408

[52] U.S. Cl. ..... 222/95; 222/107; 222/189; 222/386.5; 210/159

[51] Int. Cl.[2] ..... B65D 35/28

[58] Field of Search ..... 222/211, 212, 214, 215, 222/92, 95, 107, 386.5, 189; 239/323, 328; 210/159

[56] References Cited

UNITED STATES PATENTS

| | | | |
|---|---|---|---|
| 3,067,810 | 12/1962 | Mozic | 222/95 |
| 3,175,882 | 4/1965 | Meermans | 222/187 |
| 3,286,463 | 11/1966 | McGroarty | 55/431 X |
| 3,339,803 | 9/1967 | Wayne et al. | 222/92 |
| 3,404,813 | 10/1968 | Waxman | 222/386.5 |
| 3,486,302 | 12/1969 | Paynter | 55/159 |
| 3,883,046 | 5/1975 | Thompson | 222/386.5 |

*Primary Examiner*—Allen N. Knowles
*Attorney, Agent, or Firm*—Robert M. Sperry; L. Lee Humphries

[57] ABSTRACT

A liquid expulsion device having a tank enclosing a flexible bladder containing liquid to be expelled and an insoluble gas. Prior to expulsion the combined liquid and gas volume remains constant so that during environmental changes the bladder is forced into intimate flush contact with the tank and is incapable of flexing and becoming ruptured. Liquid is expelled through a surface tension screen that blocks passage of the gas.

5 Claims, 5 Drawing Figures

EXPULSION BLADDER

CROSS-REFERENCE TO RELATED APPLICATION

This is a refiled application of abandoned application Ser. No. 559,473, "Expulsion Bladder."

BACKGROUND OF THE INVENTION

1. Field of the Invention

This invention relates to fluid expulsion devices and more specifically to a unique packaging system including a liquid containing bladder that resists flexure prior to expulsion of the liquid.

2. Description of the Prior Art

The instant invention has broad application in any system for transferring fluid in an uncontaminated state from a storage position to a different position. A liquid expulsion device constructed in accordance with the instant invention could be utilized in various environments such as in diver's equipment, underwater seacraft, aircraft maneuvering equipment and in many types of gas generators.

Some of the benefits and advantages of the instant invention can be realized, for example, whenever the container of a liquid to be expelled is sensitive to motion changes, temperature or pressure changes, or similar types of environmental changes. For the sake of clarity and simplicity, the environment which has been chosen to explain the instant invention pertains broadly to the gas generator art and more specifically, to the rocket-missile art.

One type of fluid expulsion system in present day use incorporates a fluid expulsion tank enclosing a bladder. When the bladder is subjected to a predetermined external pressure, it collapses and squeezes the fluid into a discharge line. In certain environments precautions must be taken to minimize the intensity and frequency of flexure in the bladder walls. Flexure can cause fatigue in the bladder and diminish its capacity to perform its intended function which is forcing the fluid out of the tank at a predetermined uniform discharge rate. Intensive flexure can rupture the bladder with consequential severe hazards.

It is important, therefore, to control and preferably eliminate bladder flexure. In rocket engine applications, for example, as the ambient temperature outside the tank decreases, there is a corresponding decrease in the propellant volume. Under ordinary circumstances there would be a greatly enlarged low pressure ullage in conventional tanks. The term ullage refers to the empty or gaseous space between the surface of a liquid in a container and the walls of the container. Conventional bladders are designed to have little or no ullage. Under decreasing temperature environments the bladder begins to separate from the wall and follow the surface of the contracting propellant volume. Increases in temperature would thereafter produce a corresponding increase in the propellant volume. This would force the bladder under flexure outwardly and eventually into engagement with the tank wall. Repetitious contractions and expansion of the propellant volume under such temperature cycling conditions would cause the flexure that the instant invention seeks to eliminate.

Even more dangerous to the life span of the bladder is a condition occurring when the propellant volume is in a contracted state and the tank experiences an abrupt motion change. This would promote sloshing by the propellant which is random liquid transfer or shifting from one location to another. Sloshing causes the liquid to press against the bladder, making it endure a great amount of strain and flexure which, as mentioned, might result in rupture.

BRIEF SUMMARY AND OBJECTS OF THE INVENTION

In order to avoid the above-mentioned deficiencies of prior art fluid expulsion devices, the instant invention eliminates flexure in the bladder walls by maintaining a constant bladder volume at all times prior to when the propellant is expelled.

Thus an object of this invention is to eliminate flexure in liquid containing bladders.

Another object of this invention is to eliminate bladder flexure when the volume of liquid inside the bladder experiences temperature cycling, as well as sloshing.

In its general aspects, the fluid expulsion device of the instant invention comprehends loading a liquid to be expelled together with an inert gas into a flexible cylindrically-shaped bladder enclosed in a rigid expulsion tank. Inside the bladder is a support framework which prior to expulsion is not in contact with the bladder. The framework is designed to force the bladder to collapse according to a programmed deformation pattern when the bladder is subjected to external pressure. The volume assumed by the inert gas, hereafter called the ullage gas bubble, and the volume assumed by the liquid to be expelled both vary under temperature cycling conditions. However, the total bladder volume which is equal to the cumulative ullage gas bubble and liquid volumes always remains constant prior to liquid expulsion. Maintaining a constant volume insures that the bladder will be pressed out against the tank wall so that it cannot experience harmful flexure. When the fluid is being expelled small bubbles from the ullage gas bubble are blocked from entering a liquid discharge line by a fine mesh screen having surface tension characteristics. The surface tension characteristic is achieved when the surface tension forces of the fluid form a barrier whenever the ullage gas bubble is exposed to the screen. Thus, during liquid expulsion conditions, the screen functions to admit liquid and block bubbles from entering the liquid discharge line. Prior to liquid expulsion the ullage gas bubble assists in preventing flexure and during fluid expulsion conditions bubbles from the ullage gas are prevented from exiting from the bladder and contaminating the outflowing liquid stream.

The foregoing listed, as well as additional objects of the instant invention, will best be understood by considering the following description in connection with the accompanying drawings in which:

DETAILED DESCRIPTION OF THE INVENTION

Figure 1:
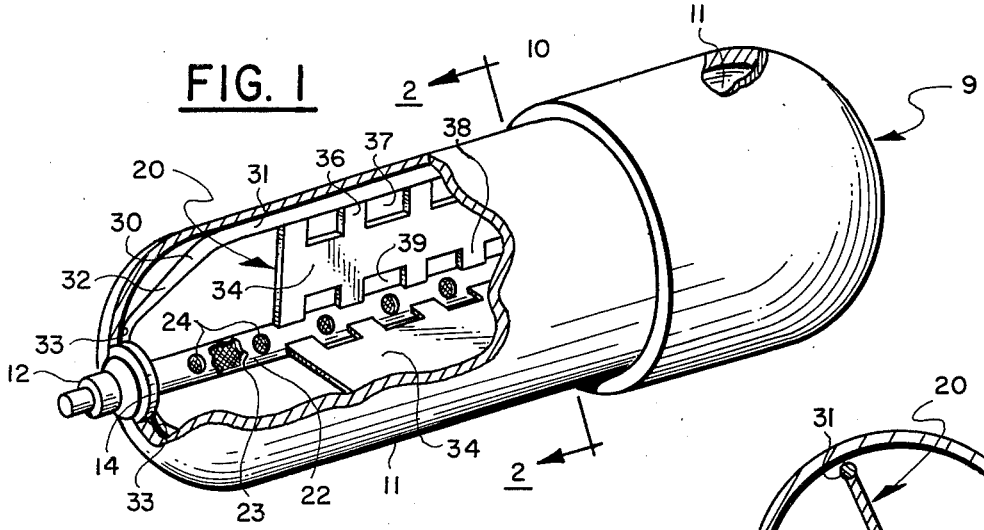
FIG. 1 is a partially sectioned perspective view of the liquid expulsion device prior to expulsion.

The liquid expulsion device of the instant invention can be understood by referring to the embodiment shown in FIG. 1. A rigid tank 9 is shown enclosing a flexible bladder 10 fully loaded with a liquid to be expelled. Bladder 10 can be fabricated, for example, of a light metal such as 0.032 inch thick 1100-0 type aluminum. It is generally of cylindrical configuration with rounded ends or domes 11. The type of aluminum mentioned is a suitable soft, weak and ductile metal that is sufficiently thick to resist sharp three-corner folds while facilitating fabrication problems. Prior to assembling the expulsion device in its ready-for-use environment, bladder 10 would be introduced into tank 9 and filled with the liquid to be expelled, as well as a quantity of inert gas. The resulting hydrostatic pressure caused by the volumes of liquid and inert gas serves to expand bladder 10. The shapes of tank 9 and bladder 10 are so contoured that when bladder 10 attains its maximum expansion under hydrostatic forces, a perfect flush, complimentary fit results. This method of arranging the tank and bladder together avoids numerous short-comings of prior art bonding techniques which are expensive to practice and frequently result in unreliable attachments.

Extending centrally along the axis of bladder 10 between domes 11 is an outlet line 22 through which the liquid can be discharged. At one end of discharge line 22 is a hub 14 which in turn is attached to a discharge nozzle 12 positioned outside bladder 10. Positioned along outlet line 22 is a series of screen covered inlet ports 24. A cylindrically shaped fine mesh screen 23 inserted coaxially in outlet line 22 provides the screen coverings for inlet ports 24. Screen 23 functions to exclude the passage of gas bubbles from the inert gas through inlet ports 24 and will be more fully explained below. Outlet line 22 is not an important feature of the instant invention. A suitable liquid discharge outlet could be installed adjacent hub 14. Prior to fluid expulsion, bladder 10 is maintained in its fully expanded condition against the walls of tank 9.

Inside bladder 10 is a support framework 20 which includes three approximately U-shaped tubes or lobes 30 extending from end to end of bladder 10. The central section 31 of each lobe 30 is substantially parallel to the major longitudinal axis of the bladder and tank and is spaced from the wall of bladder 10. The end sections 32 of lobes 30 converge toward one another and terminate in tips 33. Tips 33 are equiangularly spaced from one another and are firmly anchored, welded or otherwise rigidly attached to hub 14. Support framework 20 also incorporates three stiffening ribs 34 which contribute additional strength to the overall structure. Ribs 34 are generally of rectangular shape and are formed along their inner margins with openings 39 and lugs 38, the latter of which are attached by means of welding to outlet line 22. Similarly the upper margins of ribs 34 are formed with openings 37 and lugs 36 which are attached to corresponding lobes 30. The particular margin design on ribs 34 and the type of attachment used is dictated by ease of fabrication.

Figure 3:
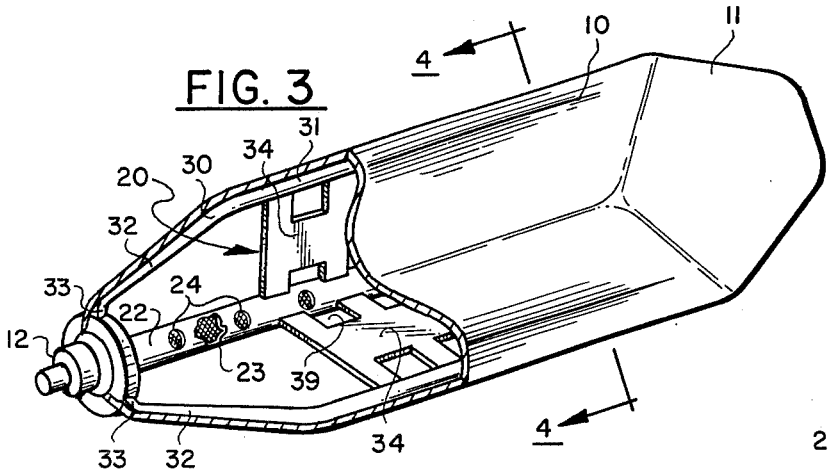
FIG. 3 is similar to FIG. 1 showing the bladder in partially collapsed condition.
Figure 4:
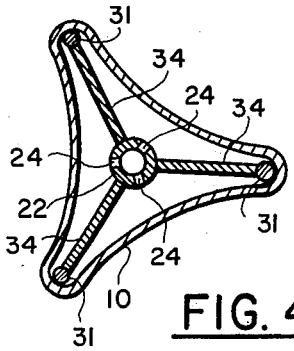
FIG. 4 is a cross-sectional view of the device taken along the line 4—4 of FIG. 3.

The main function of support framework 20 is to control the deformation configuration of bladder 10 as it is being collapsed, as shown in the FIGS. 3 and 4, under an adequate external force. The force could, for example, be pressurized gas generated by a solid gas generator that starts only in response to a command signal. Without support framework 20 and especially the three lobe support assembly, bladder 10 would be very prone to wrinkling and random folding which, during fluid expulsion, could well result in tearing and rupture. The three lobe support assembly insures that bladder 10 will be uniformly collapsed and ultimately folded so as to lie neatly and smoothly against outlet line 22. By avoiding random wrinkling and bunching up of the bladder material during fluid expulsion, less external pressure is required to fully expel the fluid.

One of the most important features of the liquid expulsion device is the provision of means to keep a constant cumulative liquid and inert gas volume in bladder 10 prior to liquid expulsion. The advantages of this feature can be appreciated, for example, when the liquid to be expelled is a propellant to be supplied to a rocket engine combustion chamber or other type of gas generator. The liquid propellant in bladder 10 can be either a fuel or a fuel propellant, both incorporating concepts of the instant invention could be utilized. For the sake of clarity and simplicity, reference will be made only to a single tank containing oxidizer propellant. As mentioned above, temperature cycling and liquid sloshing can rupture a bladder wall which is susceptible to flexure. Flexure of bladder 10 in the instant invention is absolutely restrained since the combined volume of liquid and gas inside the bladder is maintained constant prior to liquid expulsion.

Figure 2:
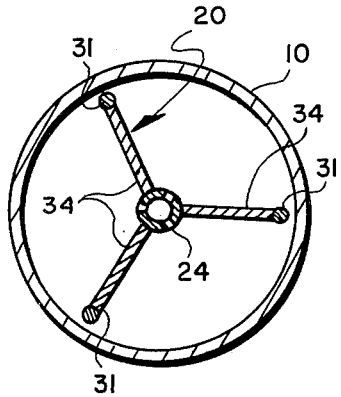
FIG. 2 is a cross-sectional view of the device taken along line 2—2 of FIG. 1.

In operation of the device an oxidizer propellant such as chlorine trifluoride would be loaded into bladder 10, along with a suitable inert gas such as argon. For example, under a temperature of +50° F, 400 pounds of $ClF_3$ and ¼ pounds of argon would be loaded into bladder 10. The argon would be introduced under a pressure of 40 psia. Under these conditions the $ClF_3$ and argon would assume volumes of 5500 and 1600 cubic inches, respectively. The volume assumed by the argon gas will hereafter be referred to as the ullage gas bubble. The volume of the ullage gas bubble, as well as the propellant volume, will vary in size while experiencing temperature changes. However, the changing volumes at all times compliment one another so as to maintain a constant volume inside bladder 10 as shown in FIGS. 1 and 2. The constant volume will keep bladder 10 pressed out against the walls of tank 9 during temperature cycling and sloshing to prevent flexure.

The pressure exerted by the ullage gas bubble is always greater than the pressure of the atmosphere surrounding tank 9. For example, assuming the maximum predetermined temperature of the tank is to be 200° F, then at this limit the gas will exert a pressure of 600 psi while assuming only 2 percent of the constant bladder volume. At a predetermined minimum temperature which may be −65° F, for example, the ullage gas bubble exerts a pressure of 20 psi and assumes approximately one-third of the constant bladder volume. The pressure in the atmosphere surrounding the tank throughout this range is less than 20 psi. Thus, as the propellant volume decreases, the ullage gas bubble increases and vice-versa so that the bladder volume never changes. The combined fluid forces keep bladder 10 smoothly pressed out against tank 9 prior to propellant expulsion.

Figure 5:
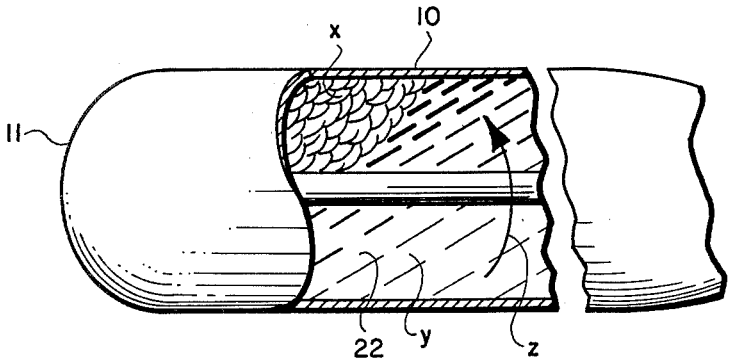
FIG. 5 is a schematic view of the liquid volume and ullage gas bubble when the liquid in the bladder is experiencing sloshing.

Another important feature of the instant invention can be realized by referring to FIG. 5 showing ullage gas bubble $x$ and liquid propellant y contained in bladder 10. When tank 10 is abruptly turned or redirected, propellant y will experience sloshing and be tranferred in the direction of the arrow so as to displace a portion at least of ullage gas bubble *x*. The force causing the shifting in the propellant and ullage gas bubble volumes could be centrifugal force. As explained above, as long as the pressure of ullage gas bubble *x* is higher than the external pressure, the combined volumes of ullage gas bubble *x* and propellant volume y will prevent flexure of bladder 10. As ullage gas bubble *x* becomes directly exposed to individual inlet ports 24, then there would be a tendency for small bubbles to enter outlet line 22. Should this occur, then smooth combustion in the combustion chamber would be interrupted and performance efficiency would be severely impaired. Contamination of propellant in outlet line 22 is prevented by fine mesh screen 23 whose pores are of a predetermined size sufficient to effect a surface tension. The surface tension characteristic serves to block bubbles from entering outlet line 22. When individual screen covered inlet ports 24 are wetted with propellant and are thereafter directly exposed to a portion of the ullage gas bubble (as schematically shown in FIG. 5) capillary action between the propellant and the pores results. The spreading or migration of the propellant due to the capillary forces develops a thin-fluid barrier across the screened sections of inlet ports 24. The surface tension barrier exists and is only needed when the ullage gas bubble becomes directly exposed to individual inlet ports 24. The small gas bubbles cannot break through the surface tension barrier and hence the potential danger of bubbles being carried into the combustion chamber is eliminated.

It can now be fully appreciated that the ullage gas bubble is utilized to prevent flexure and possibly rupturing of the bladder wall while the potential adverse effects of the ullage gas bubble are restrained because bubbles are blocked from entering outlet line 22 by the screen covered inlet ports 24.

Although the invention has been described and illustrated in detail it is to be clearly understood that the same is by way of illustration and example only and is not to be taken by way of limitation. The sprit and the scope of this invention being limited only by the terms of the appended claims.

I claim:

1. A liquid expulsion tank device containing both liquid and gas, said tank device having a framework inside of a bladder for controlling the deformation configuration of the bladder as it is being collapsed within said tank, said expulsion device further having a screen sufficient to produce a surface tension barrier to block passage therethrough of said gas, the improvement which comprises:

means to keep a constant cumulative liquid and inert gas volume in said bladder prior to liquid expulsion from said tank whereby an ullage gas bubble within said bladder is greater than the pressure of the atmosphere surrounding said expulsion device to maintain said bladder pressed out against the interior walls of said tank to prevent bladder flexure during tank temperature cycling and liquid sloshing.

2. The invention as set forth in claim 1 wherein said inert gas is argon.

3. The invention as set forth in claim 1 wherein said liquid is a liquid fuel.

4. The invention as set forth in claim 3 wherein said fuel is an oxidizer propellant such as chlorine trifluoride.

5. The invention as set forth in claim 4 wherein said means to keep a constant cumulative liquid and inert gas volume in said bladder when approximately 400 pounds of oxidizer at a temperature of 55° F and approximately ¼ pounds of argon where said argon is introduced in said tank under a pressure of about 40 psia, said oxidizer will assume a volume of about 550 cubic inches and said argon will assume a volume of 1600 cubic inches, said oxidizer and said inert gas combining to keep said bladder pressed against the interior wall of said tank, when said tank temperature reaches approximately 200° F, said inert gas will exert a pressure of about 600 psi while assuming about 2 percent of constant bladder volume and when said tank temperature reaches approximately −65° F said inert gas will exert a pressure of about 20 psi and assume approximately one-third of the constant bladder volume, the external pressure surrounding said tank being less than 20 psi will keep said bladder pressed against said interior walls of said tank regardless of temperature cycles and propellant sloshing prior to liquid expulsion from said tank.

* * * * *